United States Patent [19]

Robinson, Sr.

[11] 4,159,559

[45] Jul. 3, 1979

[54] METHOD OF MAKING PLASTIC EL LAMP

[75] Inventor: Thomas L. Robinson, Sr., East Aurora, N.Y.

[73] Assignee: T. L. Robinson Co., Inc., E. Aurora, N.Y.

[21] Appl. No.: 659,411

[22] Filed: Feb. 19, 1976

[51] Int. Cl.[2] ..... H01J 9/12

[52] U.S. Cl. ..... 29/25.14; 29/25.13

[58] Field of Search ..... 29/25.13, 25.14, 25.17, 29/25.18; 313/503, 512; 427/66, 157

[56] References Cited

U.S. PATENT DOCUMENTS

| | | | |
|---|---|---|---|
| 2,887,402 | 5/1959 | Ballard | 427/66 |
| 2,922,912 | 1/1960 | Miller | 427/66 X |
| 3,148,299 | 9/1964 | Devol et al. | 313/512 |
| 3,197,664 | 7/1965 | Sentementes et al. | 313/509 |
| 3,295,002 | 12/1966 | Amans | 313/503 |
| 3,379,915 | 4/1968 | Sentementes et al. | 313/503 |
| 3,509,401 | 4/1970 | Calley, Jr. et al. | 313/512 |

*Primary Examiner*—Richard B. Lazarus
*Attorney, Agent, or Firm*—Shlesinger, Fitzsimmons & Shlesinger

[57] ABSTRACT

In this invention a basic EL lamp structure is prepared by spray coating an EL phosphor compound onto one side of film substrate, and when the EL layer has dried, spray coating a translucent, electrically-conductive film of an indium oxide formulation onto the EL layer and the opposite side of the substrate. Although this structure will glow when an AC voltage is impressed thereacross, it is preferred to attach two foil leads to the basic lamp, and to laminate this assembly between a pair of tough, polyester films, which prevent the basic lamp from ripping or tearing. Moreover, for even greater protection, this assembly is laminated between two layers of a moisture resistant, fluorocarbon film, thus producing a panel suitable for illuminated room dividers, etc. If desired a thin metal film can be photo etched on one of the polyester films to project an image when the lamp is energized.

11 Claims, 7 Drawing Figures

METHOD OF MAKING PLASTIC EL LAMP

This invention relates to electroluminescent or EL lamps, and more particularly to an improved, plastic EL lamp capable of emitting light from each side thereof when energized.

Most EL lamps of known construction are capable of emitting light from only one surface side of the lamp. Such lamps usually include an opaque substrate (for example, a solid sheet of aluminium), generally rigid, upon which are mounted the necessary electrodes, and the electro-luminescent phosphor, which produces the illumination when an alternating or intermittent voltage source is applied across the electrodes.

Other disadvantages of prior EL lamps include the fact that they have been rather difficult to manufacture, and have been rather fragile, thus requiring extreme care in handling, storing, etc. Moreover, most such prior lamps have enjoyed rather limited utility, and as presently known, have seldom if ever been employed economically for decorative or design purposes.

It is an object of this invention therefore, to provide an improved method of producing EL lamps which can be readily adapted both for utilitarian and design purposes.

A further object of this invention is to provide an improved method which simplifies the manufacture of EL lamps, and which is relatively simple and inexpensive to perform as compared to prior such methods.

Still another object of this invention is to provide an improved, plastic EL lamp which is capable of emitting light from opposite surfaces thereof.

It is an object also of this invention to provide an EL lamp in which artistic designs can be readily incorporated to render the lamp particularly suitable for use as decorative room dividers or grilles, suspended ceiling light panels, decorative wall sections, etc.

A further object of this invention is to provide an improved EL lamp which can be made in very thin, flexible, planar sections, which in turn can be readily formed into various configurations such as for example cylindrical, conical, etc.

These and other objects of the invention will be apparent hereinafter from the specification and from the recital of the appended claims, particularly when read in conjunction with the accompanying drawings.

IN THE DRAWINGS

Figure 1:
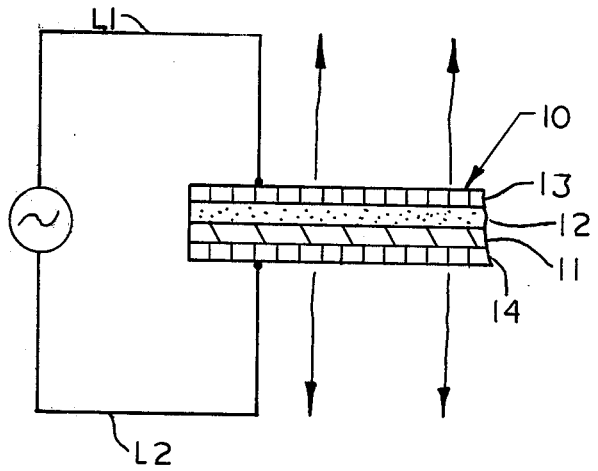
FIG. 1 is a greatly enlarged, fragmentary sectional view taken through a basic EL lamp structure made according to one embodiment of this invention, and illustrating diagrammatically how light is adapted to be emitted from opposite sides of the structure.

Referring now to the drawings by numeral of reference, and first to FIG. 1, 10 denotes generally a basic EL lamp structure made according to a first embodiment of this invention. It comprises a transparent, dielectric film substrate 11, which is made from a flexible, plastic material such as polypropylene, polyvinylidene fluoride, or the like, and which is coated on one side with a layer 12 of electroluminescent phosphor. Translucent, electrically-conductive layers 13 and 14 of an indium oxide formulation cover, respectively, the EL layer 12, and the opposite side of substrate 11.

This basic lamp structure 10 may be prepared by spray coating the layer 12 of electroluminescent phosphor onto the upper surface of substrate 11. After this EL layer has dried, the layers 13 and 14 of the indium oxide formulation may also be spray coated over the layer 12 completely to cover it, and over the underside of the substrate 11. After this the assembled layers 11 to 14 are baked in a drying oven until the coating layers are set. This takes from about twenty minutes to one half hour at a temperature of approximately 280° F., and completes the production of the basic lamp structure of this invention.

As shown in FIG. 1, if an alternating current power source or varying voltage source is connected, for example by lines L1 and L2 across the outer, electrically-conductive layers 13 and 14, respectively, the lamp 10 will become energized, and light will be emitted from the excited EL layer 12 through both of the outer, transluscent layers 13 and 14. This basic lamp structure 10 at this stage comprises a flexible sheet approximately 4 to 5 mils thick, consequently can be easily inventoried in stock sizes for use when needed. Moreover, although the basic structure 10 is capable of being excited to emit light, it generally is not used until it has been enclosed, as noted hereinafter, within additional layers of plastic which protect it from environmental hazards.

Figure 2:
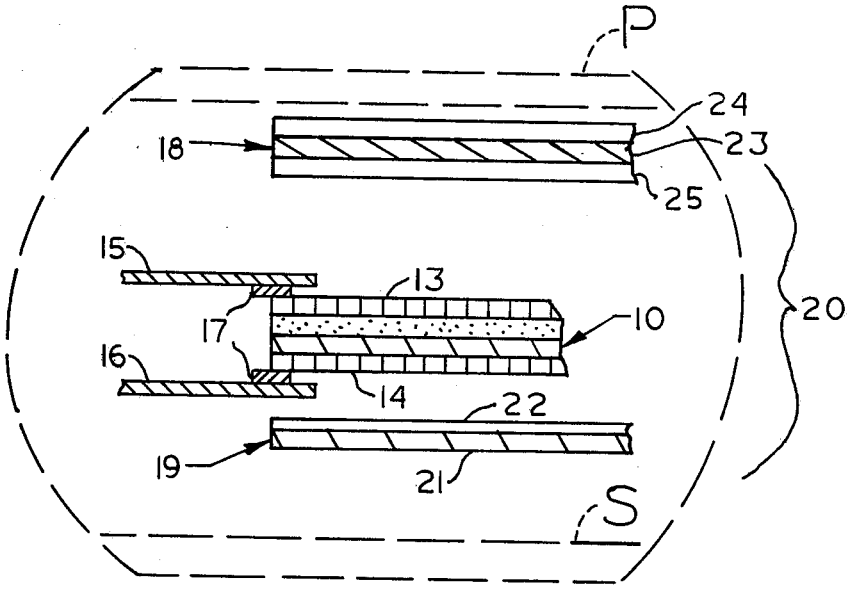
FIG. 2 is an exploded sectional view showing diagrammatically a first laminating step which is employed to secure wire leads and cover layers over the basic lamp structure shown in FIG. 1.
Figure 4:
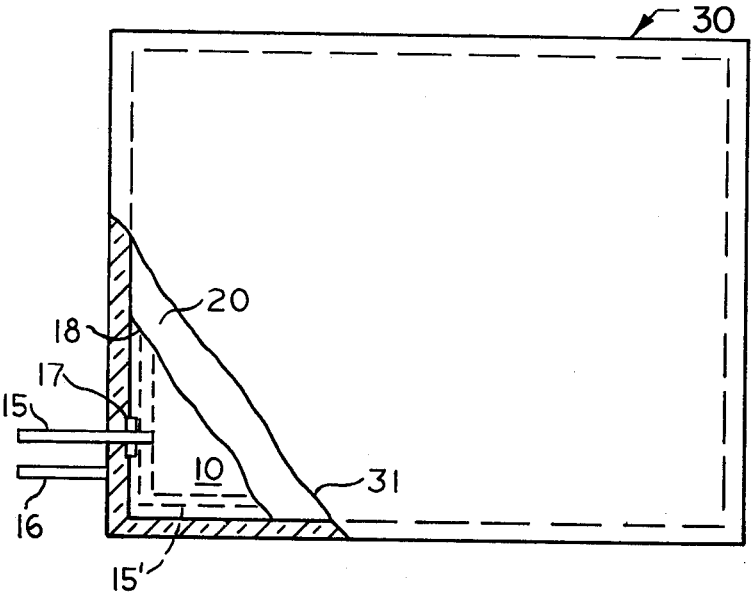
FIG. 4 is a plan view of a completed EL lamp made according to this embodiment of the invention, portions of the upper layers of the lamp being broken away for purposes of illustration.

Referring now to FIG. 2, after the basic lamp structure 10 has been cut to a desired size and configuration (rectangular in the embodiment described hereinafter), two metal foil input leads 15 and 16 are "tacked" intermediate their ends by two, small pieces 17 of pressure-sensitive, thermosetting, dielectric tape to the outer, electrically-conductive layers 13 and 14 of the section 10 so as to project outwardly beyond the edges of the associated layers 13 and 14, and in spaced, offset relation to each other as shown for example in FIG. 4. The tape pieces 17 are located intermediate the ends of their respective leads 15 and 16, so that the leads project at their inner ends beyond the tape to overlie and to be pressed into contact with the respective conducting layers 13 and 14 when the assembly is laminated as noted hereinafter. Moreover, each strip of tape 17 projects slightly beyond the adjacent edge of the associated layer 13 and 14 to function as an edge pad for the associated input lead 15 or 16, where these leads project outwardly beyond the lamp section 10.

Figure 3:
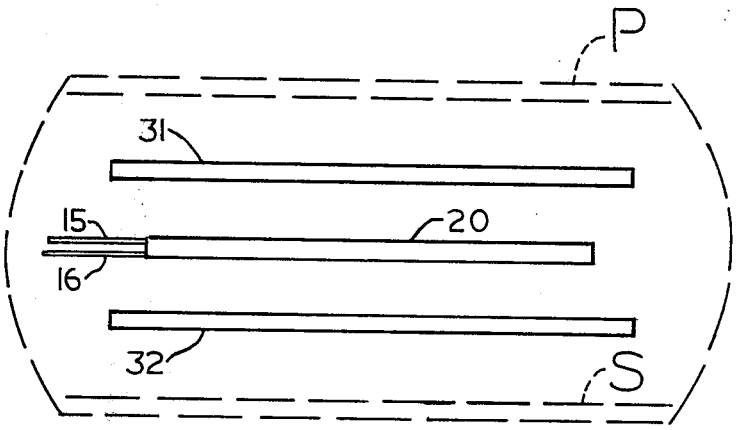
FIG. 3 illustrates diagrammatically the manner in which the product of this first laminating step is prepared for a final laminating operation.

After the leads 15 and 16 have been "tacked" to the lamp section 10, this assembly is laminated between two layers 18 and 19 of tough, transparent, polyester-polyethylene laminating film to secure the inner ends of leads 15 and 16 in electrical contact with layers 13 and 14, respectively, and to produce a monolythic lamp stack, which is denoted at 20 in FIGS. 2 and 3.

To produce the lamp stack 20 a laminating "pouch," which is denoted by broken lines at P in FIGS. 2 and 3, is placed upon the plane upper surface of an assembly table, or the like (not illustrated). The layer 19, which comprises a layer 21 of nylon having laminated to its upper surface a thin layer 22 of polyethylene, is then placed nylon-side-down on the lower surface S (FIG. 2) of the laminating pouch P, so that film 22 faces upwardly. The basic lamp section 10, with the leads 15 and 16 attached by the tape 17, is then placed on the surface 22 of the laminating layer 19, so that layer 19 overlaps the inner end of bottom lead 16 and the edges of section 10. Thereafter the upper laminating layer 18, which comprises a prelaminated assembly consisting of a layer 23 of clear, transparent nylon laminated between two outer, transparent layers 24 and 25 of polyethylene, is positioned over the top of the partially assembled lamp stack 20 as shown in FIG. 2, so that layer 18 overlaps the inner end of the upper lead 15 and the edges of section 10.

After the upper layer 18 has been placed over the assembly, the upper layer or surface of the laminating pouch P is placed over the assembled stack; and the pouch P is placed in a platen laminating press and held under heat and pressure until the layers 18 and 19 fuse with the intervening lamp section 10 into a monolythic, composite plastic sheet. This laminating step takes place at nominally 325° F. for approximately ten minutes. After this laminating cycle, the lamp stack is cooled down to room temperature while still under pressure. (The laminating pressure is determined by trial for different lamp stack heights and areas.) After cooling, the laminated assembly is removed from the press and pouch P, and is trimmed around its edges to produce the completed stack assembly 20 as shown for example in FIGS. 3 and 4.

After being trimmed into its final configuration, the lamp stack 20 is finally laminated between two layers 31 and 32 (FIG. 3) of moisture resistant plastic film, such as for example a fluorocarbon film with a polyethylene bonding surface. This is done, for example, by placing one of the layers 32 on the surface S of the pouch P, and then placing the finished lamp stack 20 on the layer 32 so that the latter overlaps the marginal edges of stack 20. The other moisture-resistant layer 31 is placed over the stack 20 to register with the layer 32; and the pouch P is closed over the top of the assembly and is again placed in the laminating press to laminate layers 31 and 32 over opposite sides of stack 20, and around the marginal edges thereof. If the finished lamp is to be employed out of doors, high temperature edge sealing of the fluorocarbon films 31 and 32 may be employed. After the second and final lamination, the completed lamp is trimmed to size to produce the finished lamp as denoted at 30 in FIG. 4.

The presence of the nylon films 21 and 23 (FIG. 2), which may be approximately 5 mils thick, stabilize the lamp stack assembly 20 mechanically against tearing and stretching. The advantage of employing the polyethylene layers 22 and 25 (FIG. 3) on the nylon film enables these nylon layers to be fused at lower temperatures and with greater ease to opposite surfaces of the basic lamp stack 10. Similarly, the surfaces of the moisture-resistant layers 31 and 32 which are employed to enclose stack 20, can also be provided on the surfaces thereof which confront the stack 20 with polyethylene layers which would likewise ease the lamination of the layers 31 and 32 to the stack 20.

As shown in FIG. 2, it is imperative that the inner ends of the foil leads 15 and 16 overlie the layers 13 and 14, so that they will be secured in electrical contact therewith as a result of the laminating operation which produces the stack 20. The areas of the input leads 15 and 16 in contact with their respective conductive layers 13 and 14, should be proportional to the total area of the resultant lamp. For example, when the lamp increases in surface area, the amount of surface area of the leads 15 and 16 in contact therewith must also increase. In very large lamps, for example, the inner ends of each lead 15 and 16 can be extended, as shown for example by broken lines at 15' in FIG. 4, to form narrow, perimetral contact surfaces around the edges of the lamp, thereby to distribute the electric current more evenly across the entire EL phosphor layer of the lamp.

In order to improve the surface appearance of the lamp 30 when it is not lit, an extra polyethylene film can be laminated to the outer surfaces thereof by means of a roller laminator. The lamp, having these extra "impressable" coatings on opposite sides thereof, is then run between a set of heated texturing rolls. The texturing operation can also be accomplished in a heated press with textured laminating plates. Moreover, the flat lamps 30 can be formed readily into conical or cylindrical shapes by wrapping the laminates, during the assembly thereof, around forming mandrels, and heat sealing the overlapping edges. Obviously the EL lamp disclosed herein can also be formed into other geometrical shapes by similar procedures.

Figure 5:
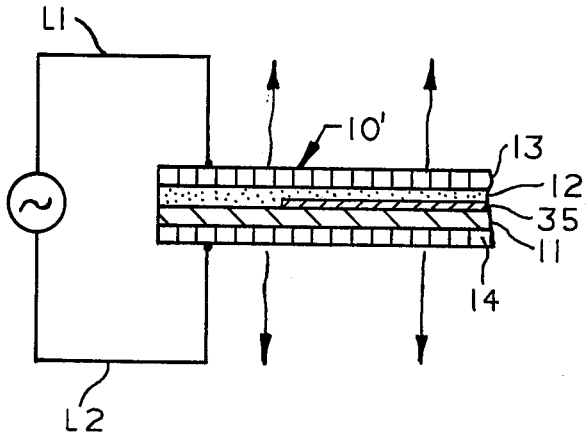
FIG. 5 is a fragmentary sectional view of a modified form of the basic EL lamp shown in FIG. 1.

The EL lamp may be esthetically enhanced by incorporating artistic designs within the lamp structure itself during processing. One manner of effecting this enhancement is illustrated by the modified basic lamp structure 10', which is illustrated in FIG. 5, wherein like numerals are employed to denote elements similar to those employed in the previously described embodiment. This modified structure comprises the usual dielectric substrate layer 11, the underside of which is coated by a layer 14 of indium oxide, as in the first embodiment. Photo-etched onto the upper surface of layer 11 is an image-producing layer or metallic film 35. This film is coated by a layer 12 of EL phosphor, as in the first embodiment, and this layer is in turn covered by the outer, indium oxide layer 13.

When an AC signal source is connected by lines L1 and L2 across opposite sides of this modified construction 10', the image produced by the layer 35 is projected from opposite sides of the assembly. In use, of course, the modified lamp section 10' would be formed into a lamp stack 20 of the type previously described; and this stack in turn would be enclosed within the layer 31 and 32 to form the finished lamp.

The steps involved in forming this modified lamp structure 10' comprises depositing a thin metallic layer on one side (the upper side as shown in FIG. 5) of the substrate 11. The metallic layer is then photosensitized in known manner with "resist," and is exposed to ultraviolet radiation through a photographic film having the desired image. When the resist is thereafter developed, the metallic film not covered by the resist will etch away to leave the desired metallic pattern or metallic image layer 35 on the face of the substrate 11. Thereafter, the additional layers 12 to 14 are applied, as of the case in the first embodiment.

The picture or image produced by the modified lamp section 10' is generated in two ways; (a) the metal image blocks EL light in one direction through the transparent dielectric film substrate 11, and (b) the metal affects the electric field across the phosphor in the areas where the EL phosphor overlies the metal image.

Figure 6:
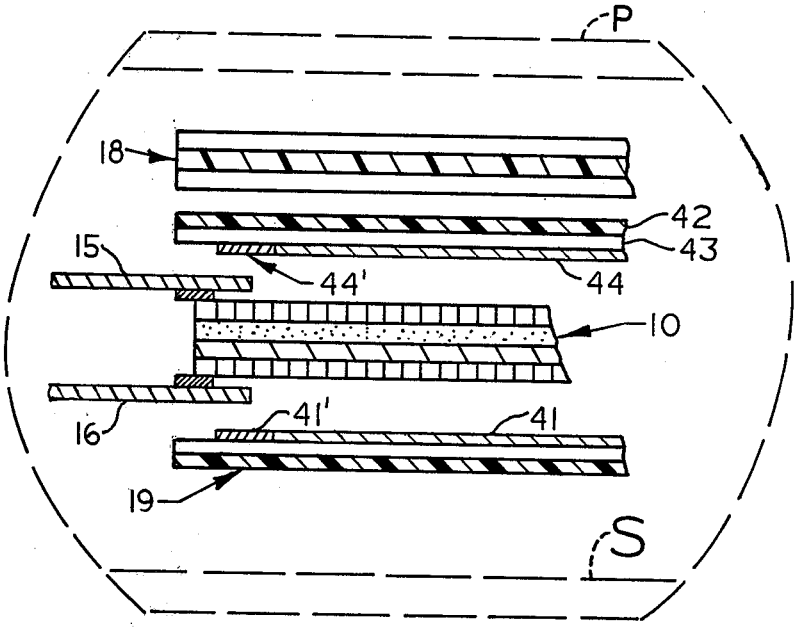
FIG. 6 is a view similar to FIG. 2, but showing still another method of producing a modified lamp structure according to this invention.
Figure 7:
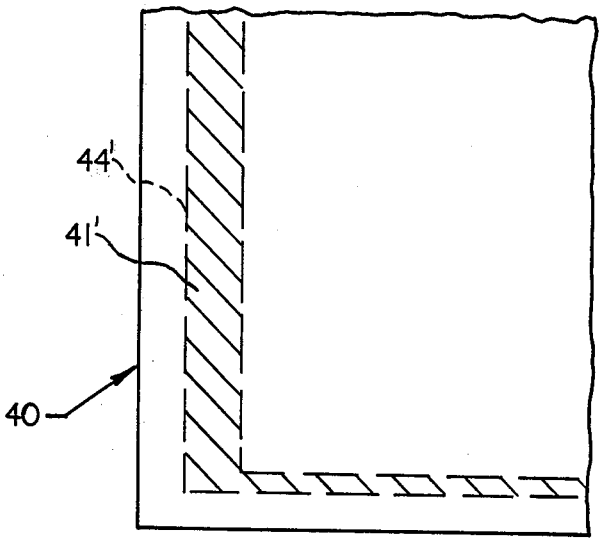
FIG. 7 is a fragmentary plan view of an EL lamp made according to the method illustrated in FIG. 6.

FIGS. 6 and 7 illustrate still another EL lamp 40 and a different method of generating therein an image of the type described. This method is similar to that disclosed in connection with FIG. 5, except that the desired image-producing metallic film 41 is photoetched onto the upper surface of the lower laminating layer 19 rather than onto the face of the film substrate 11. The image film 41 in this embodiment, moreover, includes a rectangular, metallic border 41' or diffusion ring, which completely surrounds the etched image portion of the film inwardly of the marginal edges of the supporting laminate 19. In this method an upper image sheet may also be employed comprising a layer 42 of nylon, which is coated with a film 43 of polyethylene on which, in turn, a metallic, image-producing film 44 is photo-etched on the polyethylene film 43 in a manner similar to that of the film 41. The metallic film 44 also includes around its marginal edge a diffusion ring 44' similar to that denoted at 41' on the lower image sheet.

The manner of assembling and laminating the lamp 40 (FIG. 7) is otherwise similar to those embodiments previously described. A lamp 40 made in accordance with this method will produce, when energized, an illuminated image within the boundary defined by its registering diffusion rings 41' and 44', both of which serve to distribute electric current completely around the perimeters of the respective image layers 41 and 44.

From the foregoing it will be apparent that the method disclosed herein provides a relatively simple and inexpensive means for producing extremely versatile EL lamps, which can be produced and stored in various shapes and configurations, and which can be utilized for various decorative, as well as functional purposes. The disclosed lamps emit light from both sides thereof when in alternating or varying voltages are applied to their inputs 15 and 16. The lamps disclosed herein are intended for operation on ordinary household current and at conventional 60 Hertz voltage frequencies. Since the lamps are voltage and frequency sensitive, any increase in either of these two parameters will, of course, increase the brightness of the respective lamps. The lamps are particularly suitable for decorative room dividers or grilles, suspended ceiling light panels, decorative sections for wall illumination purposes, pole lamps, etc. The lamps can be heat sealed and textured on one or both sides, by heated texturing plates or rolls and, if desired, metallic layers can be incorporated directly within the lamp during manufacture thereof. The above-described spray coating steps can be performed by any standard spray coating equipment; and the basic lamp structures 10, 10', as well as the lamp stacks 20, are so thin that they can be punched, and or sheared by inexpensive steel-roll dies, and paper cutting equipment.

While this invention has been described in detail with only certain embodiments thereof, it will be apparent that this application is intended to cover any such modifications thereof as may fall within the scope of one skilled in the art, or the appended claims.

Having thus described my invention, what I claim is:

1. A method of making flexible electroluminescent lamps, comprising applying an electroluminescent phosphor formulation to one side of a flat, dielectric, transparent film substrate to form thereon an electrically excitable EL layer, coating said EL layer and the opposite side of said substrate with an indium oxide formulation, curing the coating to cause it to form translucent, electrically-conductive films over said EL layer and said opposite side of said substrate, respectively, attaching one end of each of a pair of electrical leads to a different one of said electrically-conductive films, so that the other end of each lead projects beyond said substrate, and sealing the coated substrate in a transparent plastic jacket with said one end of each lead in electrical contact with the respective film to which it is attached, and with said other ends of said leads projecting from said jacket for connection to a voltage supply.

2. A method as defined in claim 1, including depositing a thin metallic film on said one side of said substrate before applying the EL layer to said substrate, photo-etching said metallic film to remove portions of said metallic film, and thereafter coating said one side of said substrate and the remaining portions of said metallic film with said electroluminescent phosphor formulation.

3. A method as defined in claim 1, wherein the step of sealing the coated substrate includes placing the coated substrate with the leads attached thereto between two layers of plastic film which overlap each other around the edges of said coated substrate, and laminating said plastic film layers under heat and pressure to opposite sides of said coated substrate.

4. A method as defined in claim 3, wherein said sealing step further includes laminating the product of the first-named laminating step between two, transparent layers of a moisture resistant plastic film.

5. A method as defined in claim 3, including laminating a layer of polyethylene film to each of said layers of plastic film before the first-named laminating step, and placing the plastic films so that the polyethylene layers thereon contact opposite sides of the coated substrate during said first-named laminating step.

6. A method as defined in claim 5, including depositing a thin metallic film on at least one of said layers of polyethylene, and photo-etching said metallic film to remove selected portions thereof before laminating said plastic layers to said coated substrate.

7. A method of making flexible electroluminescent lamps, comprising applying an electroluminescent phosphor formulation to one side of a flat, dielectric, transparent film substrate to form thereon an electrically excitable EL layer, coating said EL layer and the opposite side of said substrate with an indium oxide formulation, curing the coating to cause it to form translucent, electrically-conductive films over said EL layer and said opposite side of said substrate, respectively, attaching one end of each of a pair of electrical leads to a different one of said electrically-conductive films, so that the other end of each lead projects beyond said substrate, and sealing the coated substrate in a transparent plastic jacket with said one end of each lead in electrical contact with the respective film to which it is attached, and with said other ends of said leads projecting from said jacket for connection to a voltage supply, the step of sealing the coated substrate including placing the coated substrate with the leads attached thereto between two layers of plastic film which overlap each other around the edges of said coated substrate, and laminating said plastic film layers under heat and pressure to opposite sides of said coated substrate, said securing step comprising initially fastening each of said leads intermediate its ends to one of said electrically conductive films with a piece of pressure-sensitive, thermosetting dielectric tape so that said one end of each lead overlies the conductive film to which it is to be secured, and so that the tape projects sightly beyond the edge of the coated substrate beneath the portion of the lead that projects beyond the edge of the substrate, and said laminating step securing said one end of each lead in contact with its associated film.

8. A method of making an electroluminescent lamp, comprising coating one side of a transparent, dielectric substrate with a thin layer of electroluminescent phosphor material, applying thin, translucent, electrically-conductive films over said coating of electroluminescent phosphor and over the opposite side of said substrate, respectively, securing each of two strips of metal foil intermediate its ends to a different one of said films for electrical contact therewith.

laminating two transparent layers of polyester material over said films on said substrate, and over the ends of the foil strips in contact therewith, so that portions of said strips extend exteriorly of the laminated assembly, and sealing the laminated assembly between two transparent layers of moisture resistant, plastic film, including laminating the two last-named layers to said polyester layers and to each other around the edges of said laminated assembly.

9. A method as defined in claim 8, wherein the step of applying said electrically-conductive films comprises spray coating an indium oxide formulation onto said coating of phosphor, after it has dried, and said opposite side of said substrate, and baking the coated substrate in a drying oven until the coated layers have set.

10. A method as defined in claim 9, wherein the first-named laminating step comprises stacking the coated substrate in a laminating pouch between two said layers of polyester, placing the pouch in a platen laminating press and holding the stack therein under heat and pressure, and after a predetermined interval allowing the stack to cool to room temperature while still under pressure.

11. A method as defined in claim 8, including photoetching an image-producing metal film onto one of said polyester films before laminating the last-named film to the coated substrate.

* * * * *